US006112336A

United States Patent [19]

Markle et al.

[11] Patent Number: 6,112,336

[45] Date of Patent: Sep. 5, 2000

[54] HINGED COVER LIFTING AND LOWERING DEVICE

[75] Inventors: Evan A. Markle; Jeff R. Morgan, both of Calgary, Canada

[73] Assignee: Winq Industries Inc., San Diego, Calif.

[21] Appl. No.: 09/348,505

[22] Filed: Jul. 7, 1999

[30] Foreign Application Priority Data

Jul. 8, 1998 [CA] Canada ..... 2242475

[51] Int. Cl.[7] ..... A47K 13/10

[52] U.S. Cl. ..... 4/246.1; 4/246.3; 74/96; 74/512; 74/517; 16/400

[58] Field of Search ..... 4/246.1, 246.2, 4/246.3, 246.4, 246.5, 249, 250; 74/96, 512, 516, 517, 496, 497, 500.5, 505, 506, 518; 220/262, 263, 264, 831, 829, FOR 193; 49/331, 332, 339, 379, 394, 449; 251/251, 294; 108/6, 7, 9; 16/400, 905, DIG. 7, FOR 101

[56] References Cited

U.S. PATENT DOCUMENTS

| | | | |
|---|---|---|---|
| D. 384,138 | 9/1997 | Jowett . | |
| D. 387,141 | 12/1997 | Vargas Salas . | |
| D. 389,231 | 1/1998 | Yarbrough et al. . | |
| 1,489,548 | 4/1924 | Roberts et al. . | |
| 1,616,509 | 2/1927 | Rehn . | |
| 1,651,784 | 12/1927 | Ulrich . | |
| 1,736,784 | 11/1929 | Gloekler . | |
| 2,042,276 | 5/1936 | Revers . | |
| 2,214,229 | 9/1940 | Frasch . | |
| 2,329,240 | 9/1943 | Bendon et al. . | |
| 2,663,047 | 12/1953 | Grenzeback . | |
| 2,772,422 | 12/1956 | Knudsen . | |
| 2,986,745 | 6/1961 | Melzassard . | |
| 3,095,582 | 7/1963 | Booth . | |
| 4,807,307 | 2/1989 | Sato et al. . | |
| 4,951,323 | 8/1990 | Shalom | 4/251 |
| 4,975,988 | 12/1990 | Won | 4/251 |
| 5,323,496 | 6/1994 | Blair . | |
| 5,546,612 | 8/1996 | Johnson . | |
| 5,594,958 | 1/1997 | Nguyen . | |
| 5,626,059 | 5/1997 | Bobbitt, III et al. | 74/493 |
| 5,754,985 | 5/1998 | Dias | 4/246.1 |
| 5,781,938 | 7/1998 | Anderson | 4/246.1 |

*Primary Examiner*—Henry J. Recla
*Assistant Examiner*—Khoa Huynh
*Attorney, Agent, or Firm*—Sean W. Goodwin

[57] ABSTRACT

An apparatus for manipulating a cover or lid between horizontal and upright positions. A foot-actuated device is connected by a first cable to a lift mechanism positioned about the lid's pivot. The first cable lies over the profile of an oblong cam in the lift mechanism. Pulling the first cable rotates the cam for rotating the lid. The cam's profile initially produces a large turning moment which compensates for the initially difficult lift and then smoothly decreases the turning moment to compensate for the decreasing force needed as the lid approaches the upright position. In the context of a toilet seat lid, it is convenient to incorporate an automatic lowering device. In upright position, a latch in the cam engages a trigger. The seat is spring-urged to close, restrained only by the latch and trigger. A second cable is float-actuated to disengage the trigger from the latch when the tank begins to refill after being flushed. Preferably, the foot-actuated device is a double hinge located between a base and a semicircular pedal. Depression of the pedal causes two points of the hinge to retreat, pulling the first cable and actuating the cam's rotation and lifting of the lid.

10 Claims, 10 Drawing Sheets

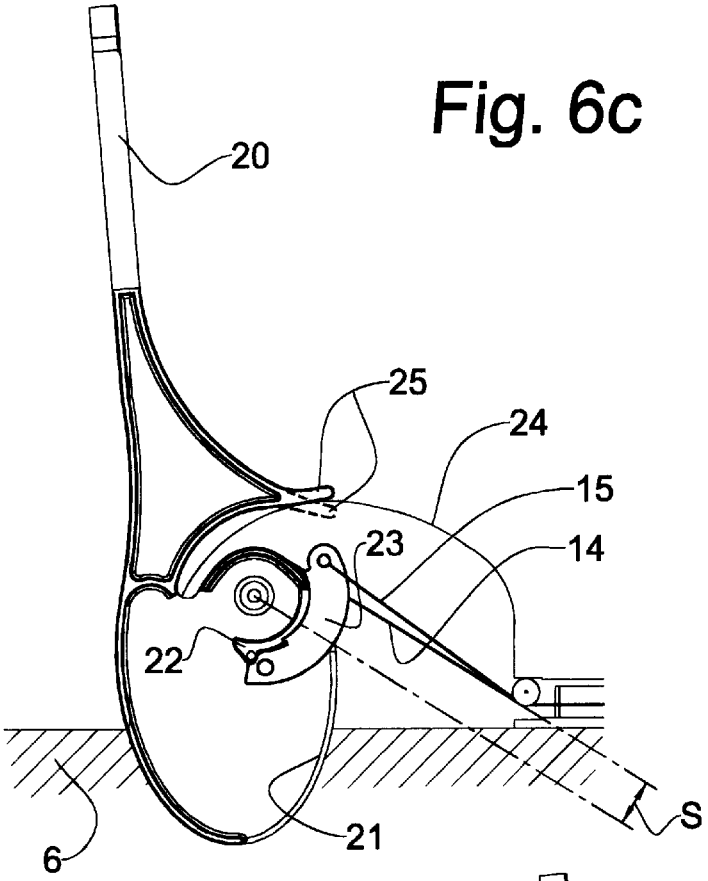
Fig. 6c
Fig. 6d
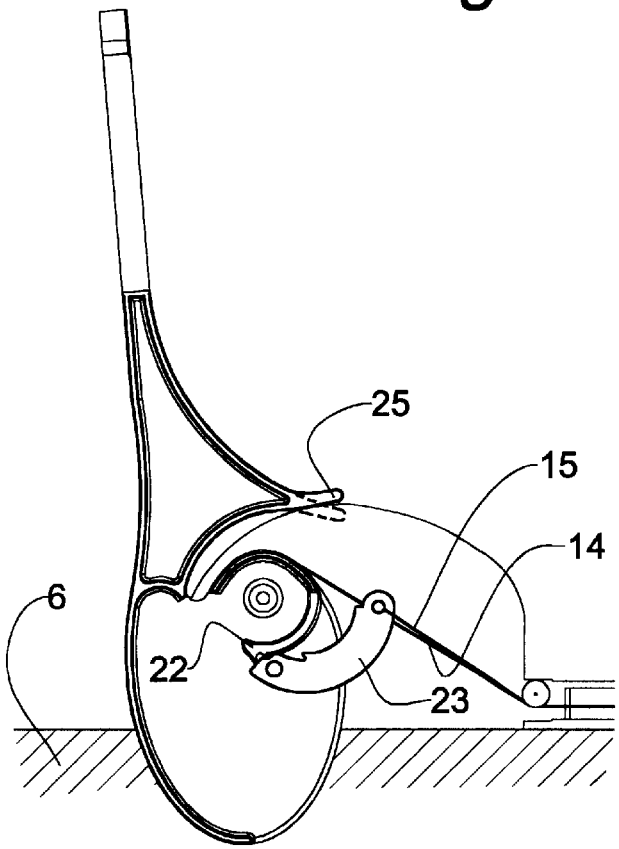

HINGED COVER LIFTING AND LOWERING DEVICE

FIELD OF THE INVENTION

The invention is related to a system and apparatus for hand-free operation of hinged lids, specifically toilet covers or seats.

BACKGROUND OF THE INVENTION

Many prior art devices are known for manipulating the seat of a toilet without the need to use one's hands. Typically the issue is one of hygiene. Other factors, broader than for use with toilets include the desire to open a container's lid by foot-operated means, so as to enable both hands to be otherwise occupied, such as when carrying garbage. A foot-operated pedal which actuates a bar and a hinged lid is a common mechanism used with household garbage cans for example.

The range of art applied to toilets ranges from U.S. Pat. No. 1,616,509 to Rehn which, in 1924, taught use of a foot pedal, a push rod and a simple lever attached to a the hinge of a toilet seat. The hinge itself includes a coiled spring and hydraulic damper to control end-of-lift movement. More recently, in U.S. Pat. No. 5,323,496 to Blair, again a foot pedal and push rod are used with the addition of a pair of air-bellows which detect lowering of the seat and cause the toilet to flush.

One of the difficulties associated remote actuation of the toilet seat is the variability in the turning moment required to first lift a lid or seat from the horizontal (maximum) and when it is vertical (minimum or zero). As a result, devices which can overcome the lifting resistance of a horizontal lid, when lowered, tend to over-rotate or slam the lid when it approaches the vertical.

U.S. Pat. No. 2,329,240 to Bendon et al. discloses a toilet seat lifting mechanism incorporating a check stop and a seat position-sensitive resistance. A foot pedal is directly connected to a toilet seat. A lever is actuated to turn a seat pivoting shaft. Two cams are located on the shaft: a first eccentric cam which bears against a spring to variably restrict the shaft's movement dependent on its position; and a second cam which temporarily locks the seat in the lower position until the person's weight releases it enabling the spring-loaded seat to lift again. U.S. Pat. No. 2,986,745 to Melzassard discloses an embodiment of a toilet having a lever and profiled slotted cam-plate which enables the lid and seat to be raised as one and then independently lowered. Unlike Bendon, this cam-plate is profiled only to provide coupled lift and independent lower capabilities.

The above prior art references utilize fixed levers and push rod actuation, leaving little variation and flexibility in the means of actuation.

U.S. Design Patent to Jowett D384,138 utilizes a foot pedal and cable to actuate a toilet seat, the cable permitting variation in foot pedal placement but does permit seat-position sensitive actuation.

Despite the prevalence of prior art, applicants are not aware of apparatus which is simple in its operation, flexible in its interface with the user and yet permits lid position-sensitive actuation.

SUMMARY OF THE INVENTION

A system and a synergistic combination of apparatus is provided for both lifting and closing the hinged cover or lid of a toilet, garbage can or similar apparatus where hands-free operation is desirable.

Generally, in a preferred application applied to a toilet seat, both novel lifting and novel lowering aspects are applied. The toilet embodiment comprises a foot pedal and a first cable used to lift the lid or seat; the first cable actuating a cam and lift arm at the seat's hinge. The first cable rotates the cam, initially producing a large turning moment which compensates for the initially difficult lift and then smoothly decreasing the turning moment to compensate for the decreasing force needed as the lid approaches the upright position. The cam is mounted to the lift arm and the lift arm is mounted to the lid.

Further, in the context of a toilet, it is convenient to incorporate an automatic seat-lowering device. Accordingly, in the fully-up position, a latch portion of the cam engages a trigger. The seat is spring-urged to close, restrained only by the latch and trigger. A second cable actuates the trigger using a tank float which disengages the trigger from the latch when the tank begins to refill after being flushed.

The preferred embodiment demonstrates the general principle wherein the cam's profile permits a relatively constant load on the first cable which results in a variable moment about a seat or lid hinge as it lifts and lowers. As a result, the apparatus meets both the challenges of lifting and lowering a lid. While lifting, the present invention provides the necessary strong mechanical advantage to pivot and lift the heavy lid from horizontal, and reduced mechanical advantage as the lid reaches vertical thereby avoiding rapid rotation of the lid and the associated possibility of forceful impact and damage at the fully open position. Further, while lowering, the present invention provides resistance as the lid pivots downwardly so it does not free fall yet does not take too long to fall, and the cam provides an ever larger mechanical advantage as the lid reaches horizontal so as to brake the lid's fall before it hits the container or toilet rim.

In one broad aspect then, the invention comprises:

- a pivoted arm attached to the cover or lid of a container (i.e. a tank, a garbage can or a toilet bowl) and is pivoted at the lid's pivot point;
- an oblong cam fitted to the arm and arm having a first cable lying peripherally over the cam's profile so that the cam must rotate when the cable is pulled. The cam profile is basically an "unwinding circle" which, when actuated by the first cable, produces an initially large lever arm to counteract the large resisting moment of the lid and lift it from the horizontal and, as the cam rotates, the lever arm becomes smaller and smaller corresponding to smaller resisting moment as the lid's center of gravity rises over its pivot, ultimately reaching a zero resistive moment when vertical. The first cable has a substantially constant tension throughout its actuation; and
- actuating means for pulling the first cable to raise the lid, preferably a foot-operated pedal.

Preferably, a trigger is provided for engaging a latch in the cam at the fully open position so as to maintain the lid in the vertical position against the bias of a spring. The spring pre-loads and initiates lowering of the lid and rotation of the cam when the latch is released.

More preferably, the trigger and latch are released using a second cable and means such as a float and lever arm, which rotates on a fulcrum when the float rises, for pulling the second cable when the tank refills and thus triggering release of the latch and initiating lowering of the lid. The movement of the lid is resisted by retarding movement of the first cable when the lid is released to fall while the cam further varies the moment arm and maintains a constant load on the first cable.

BRIEF DESCRIPTION OF THE DRAWINGS

FIGS. 6*a*–6*d* are cross-sectional views of the lift mechanism in various stages of operation. The housing is only shown in profile. More particularly, FIG. 6*a* depicts the lowered position having maximal first cable/cam moment, FIG. 6*b* depicts an intermediate raised position and intermediate first cable/cam moment, FIG. 6*c* depicts the fully raised position and minimal first cable/cam moment and the release biasing means engaging the housing for preloading the latch;

FIG. 6*d* depicts the release of the latch and initiation of the lowering of the seat;

DETAILED DESCRIPTION OF THE PREFERRED EMBODIMENT

While the invention is described in the context of a toilet seat hinged from a toilet bowl, it is understood that the cam lifting device is of broad application and works equally well for pivoting a cover or lid of other containers from a horizontal position through to a vertical position.

Figure 1:
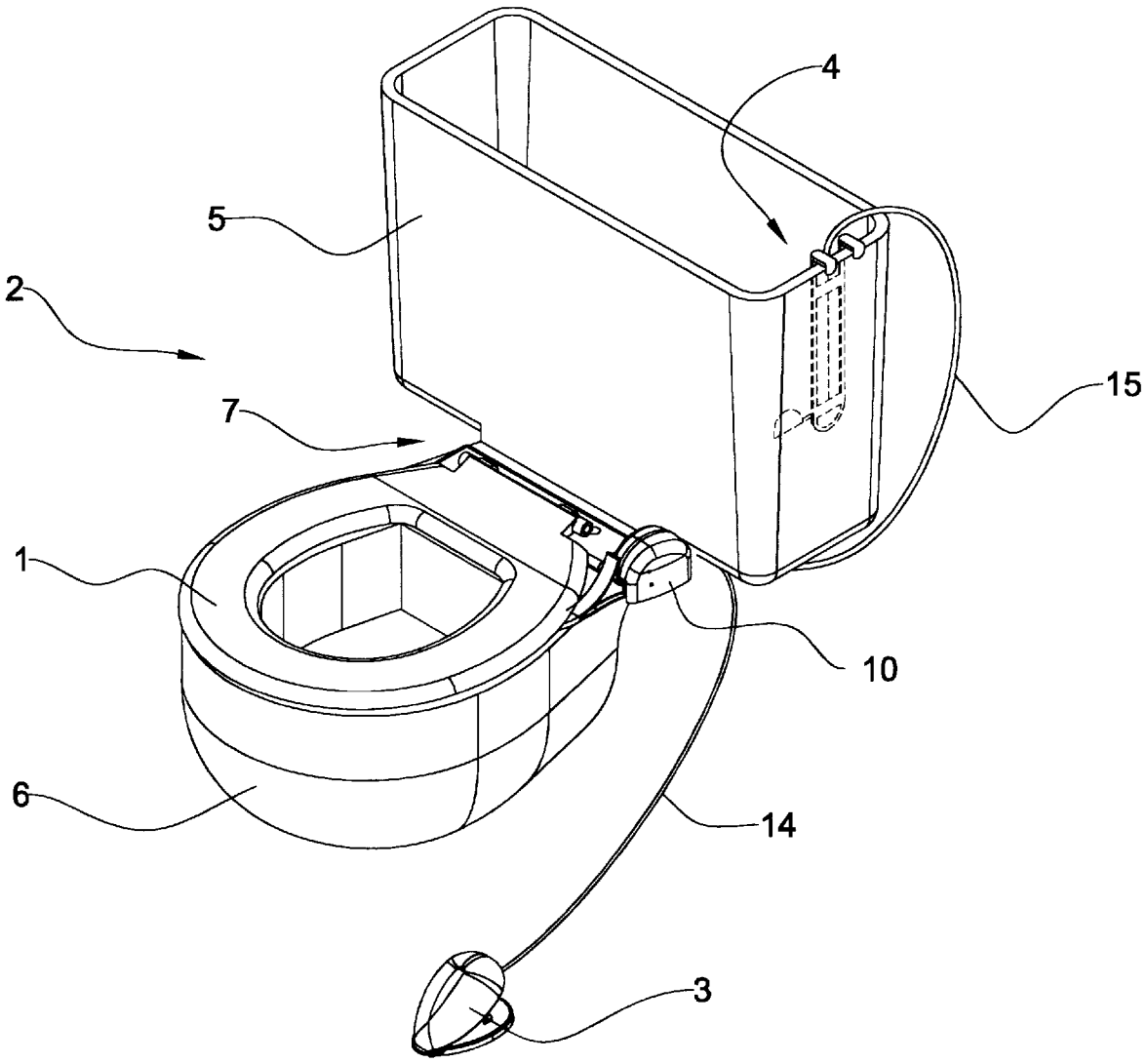
FIG. 1 is a perspective view of one implementation of the present invention, fitted to a toilet for hands-free manipulation of the toilet seat. The figure illustrates a foot pedal, a first cable, a lift mechanism, a second cable (hidden lines) and a seat release (hidden from view within the toilet's tank)

Having reference to FIG. 1, an embodiment of the present invention enables a seat 1 of a toilet 2 to be raised with a foot-actuated device 3 and to be lowered automatically and smoothly using a release mechanism 4 responsive to a change in water level that occurs in the tank 5 during the flush cycle.

The toilet seat 1 is mounted to the base 6 of the toilet 2 and rotates on a pivot 7. The seat 1 is an elongate member movable about and extending from the pivot 7.

Figure 2:
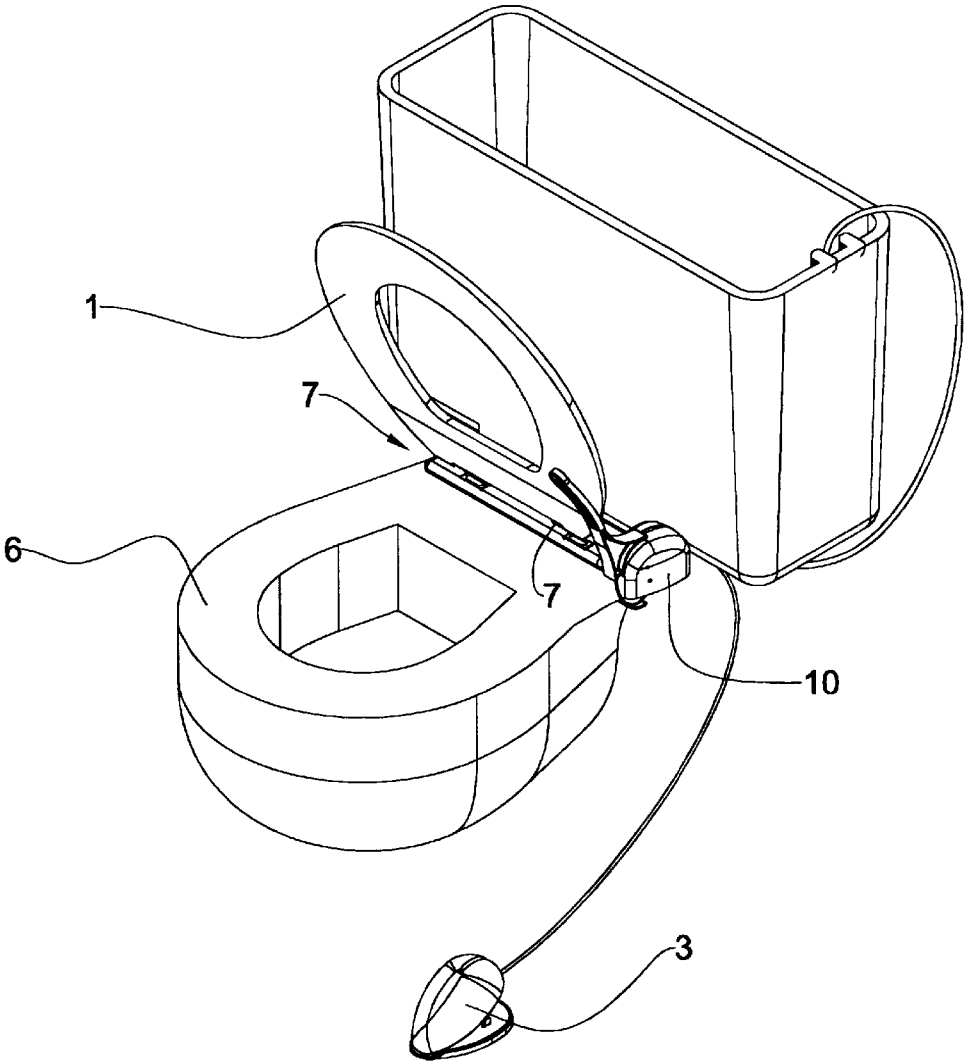
FIG. 2 is a perspective view according to FIG. 1 illustrating the seat in the nearly upright position.

Note that a greater turning force or moment is required to lift the seat 1 from horizontal shown in FIG. 1, where the center of gravity is far from the seat's pivot 7, than is required at the top of the seat's rotation shown in FIG. 2, where the seat's center of gravity is substantially above the pivot 7.

Figure 3:
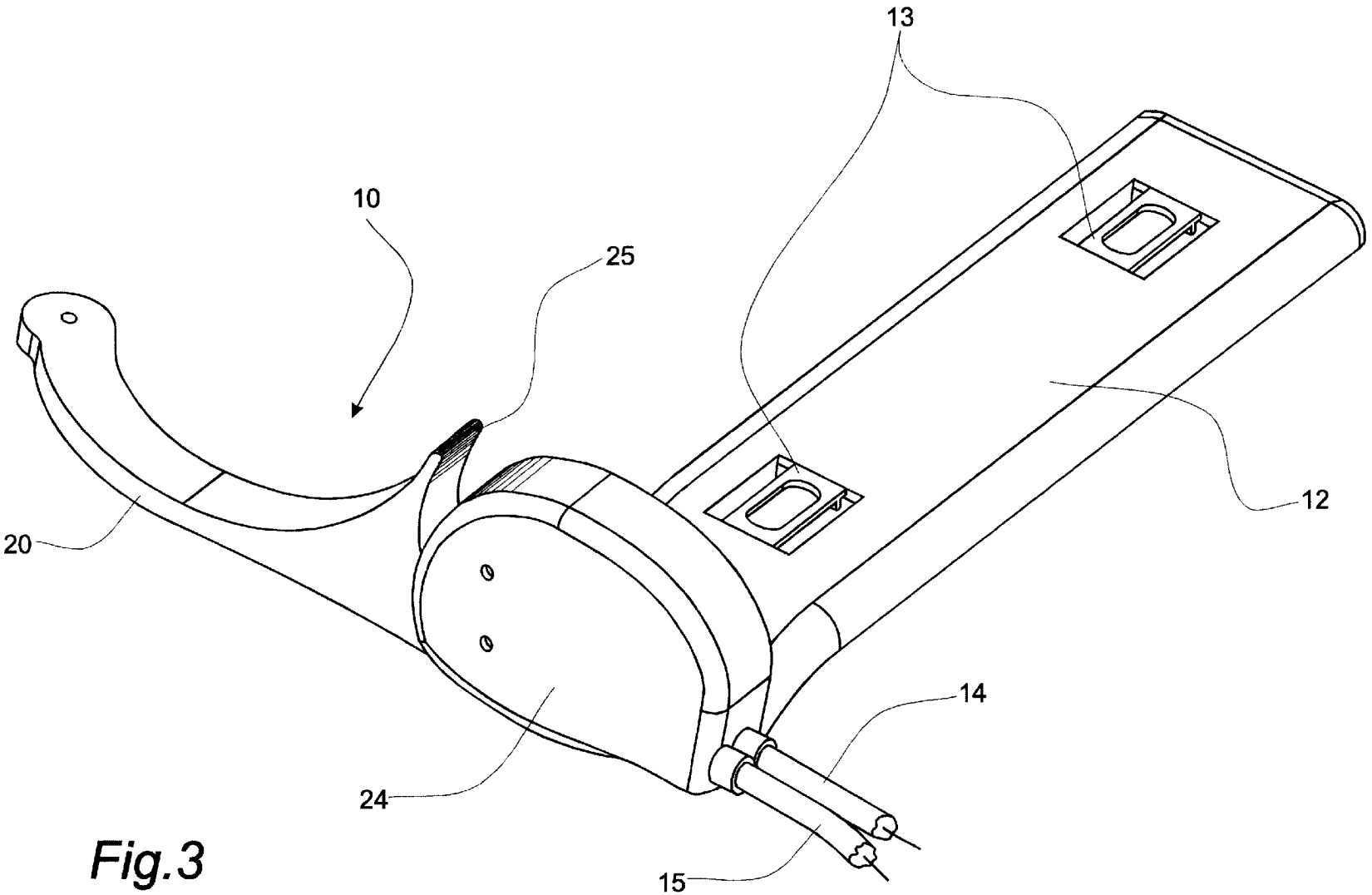
FIG. 3 is a perspective view of a lift mechanism applied to an embodiment of the invention according to FIG. 1.

Referring to FIGS. 1 and 3, a lift mechanism 10, enables rotation of the seat 1 about its pivot 7 without requiring contact with the seat 1 itself. The lift mechanism 10 comprises a bracket 12 for mounting to the toilet's base 6 using standard toilet seat mounting bolt holes 13 in the toilet's base 6.

Figure 4A:
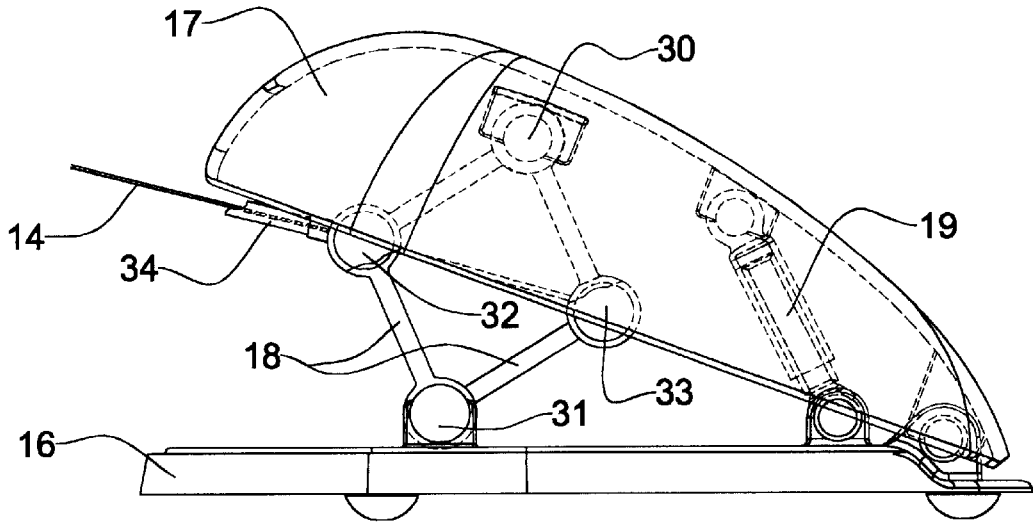
FIGS. 4*a* and 4*b* are side views of the foot pedal in the raised and depressed positions respectively.
Figure 4B:
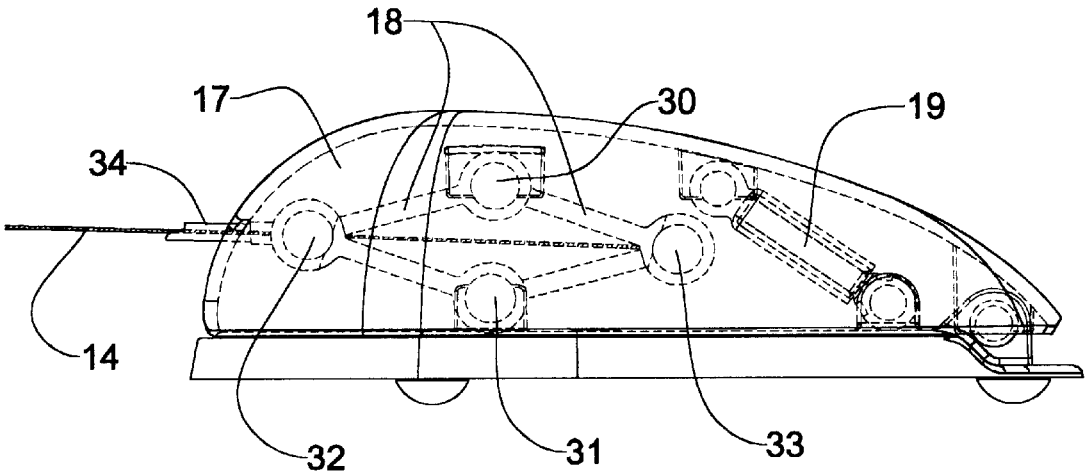
Figure 5:
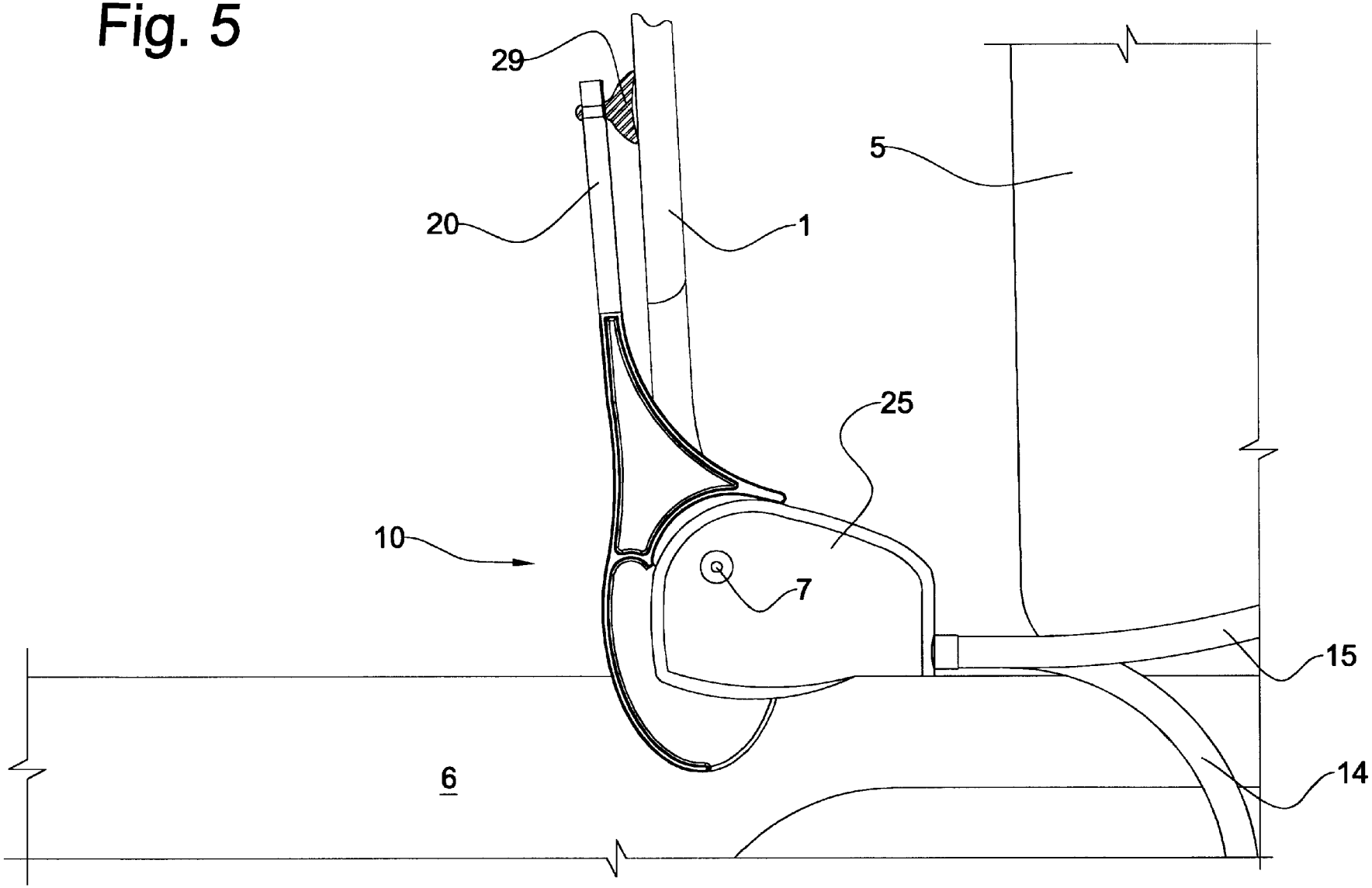
FIG. 5 is a partial side view of the toilet, specifically of the lift mechanism with its pivot arm in the raised position.

The foot-actuated device 3 of FIGS. 1, 4*a* and 4*b* connects to the lift mechanism 10 using a first cable 14. A second cable 15 extends between and connects the lift mechanism 10 to the release mechanism 4.

The foot-actuating device 3 comprises a base 16, a pedal 17 and a four-point double hinge 18 for pulling the first cable relative to lift mechanism 10 for lifting the seat 1. Two points 30,31 are opposing and two other points 32,33 are also opposing. An adjustable spring 19 located between the pedal 17 and the base 16 assists in returning the pedal to its raised position. The surface of the pedal 17 is approximately semicircular, in any event being curved in such a way that the apex of the curve is situated directly over the approaching hinge points, causing maximal actuation of the four-point hinge 18 when depressed.

More specifically, and referring to FIGS. 3, 6*a*–6*d* and 8, the lift mechanism 10 comprises the bracket 12, a pivot arm 20, a cam 21, a cocking latch 22, a trigger 23, a housing 24 and a biasing member or leaf spring 25. The cam 21, the latch 22 and trigger 23 are formed of plastic.

The pivot arm 20 rotates about the same axis as the seat pivot 7. The cam 21 rotates about the seat pivot 7. Rotation of the cam 21 rotates the pivot arm 20 and thus manipulates the raising and lowering of the seat 1. A suction cup 29 at the distal end of arm 20 connects the seat and arm. The lift mechanism 10 does not impede the raising or lowering of the seat by hand.

Having reference to FIG. 4*a* and 4*b,* depressing of the pedal 17 compresses the vertically spaced points 30,31 of the double hinge 18, causing the laterally spaced points 32,33 to separate, effectively drawing first cable 14 out of sheath 34. In the collapsed position (FIG. 4*b*), more first cable 14 is shown pulled from the sheath 34 than at the relaxed position (FIG. 4*a*), leaving less first cable 14 at the lift mechanism 10. The sheath 34 is constrained at housing 24.

First cable 14 causes cam 21 to pivot about the same axis as pivot 7. First cable 14 overlies the top profile of cam 21. When pedal 17 is depressed, less first cable 14 at the housing 24 means the first cable 14 pulls the cam 21 relative to the housing 24, rotating the cam 21. The moment created by the first cable rotating the cam about pivot 7 is dependent upon the perpendicular distance or radius of the pivot from the tangent of the first cable leaving the cam profile.

The cam 21 has a profile which presents a variable distance from the pivot. Accordingly, the profile of the cam 21 is egg-shaped or oblong, preferably elliptical, pivoting about one focus point or pivot 7. First cable 14 lies peripherally over the cam's profile so that the cam 21 must rotate when the first cable 14 is pulled. The cam 21 is connected to the pivot arm 20 which bears against the underside of the seat 1. When the cam 21 rotates, the pivots arm 20 also rotates and acts on the underside of the toilet seat 1 to cause it to rotate and lift as well.

The cam's profile is oriented to the pivot arm 20 and seat 1 so that, when the seat 1 is in the lowered position, the first cable pulls along a tangent spaced a maximal distance away from the pivot 7. For an approximately elliptical profile, such an orientation would be where the cam's major axis is approximately parallel with the pivot arm 20. The large radius or spacing S of the tangent cable and pivot 7, when the seat is lowered, produces a large moment to counteract the large resisting moment of the seat 1 and lift it from the horizontal. As the seat 1 and cam 21 rotate upwardly, the cam profile changes, locating the first cable closer and closer to the pivot, lessening the spacing S. The cam 21 and moment produced by the first cable 14 becomes smaller and smaller, corresponding to the lid's smaller resistive moment as the center of gravity rises over its pivot 7, ultimately reaching a zero resistive moment when vertically upright. The profile of the cam 21 is optimally designed so as to lift the seat 1, under variable moment conditions while maintaining a substantially constant tension in first cable 14 throughout its actuation.

When rotated fully upright, the cocking latch 22 engages the trigger 23, holding the seat 1 in the upright position. The trigger 23 actuates the latch 22 to release the seat 1 when appropriate—in the case of a toilet, sometime after the tank 5 is flushed.

The housing 24 both protects the cam 21 and latch 22 and also cooperates in subsequent lowering of the seat 1. More particularly, a biasing means, such as a leaf spring 25 interferes with the housing 24 at the upright position, loading the pivot arm 20 so that when the latch 22 is released the seat 1 is urged to lower.

In operation, and having reference to FIGS. 6*a* through 6*d,* as the cam 21 rotates, the first cable 14 over the cam 21 varies the turning moment which is imparted into the pivot arm 21 and into the seat 1.

Figure 6A:
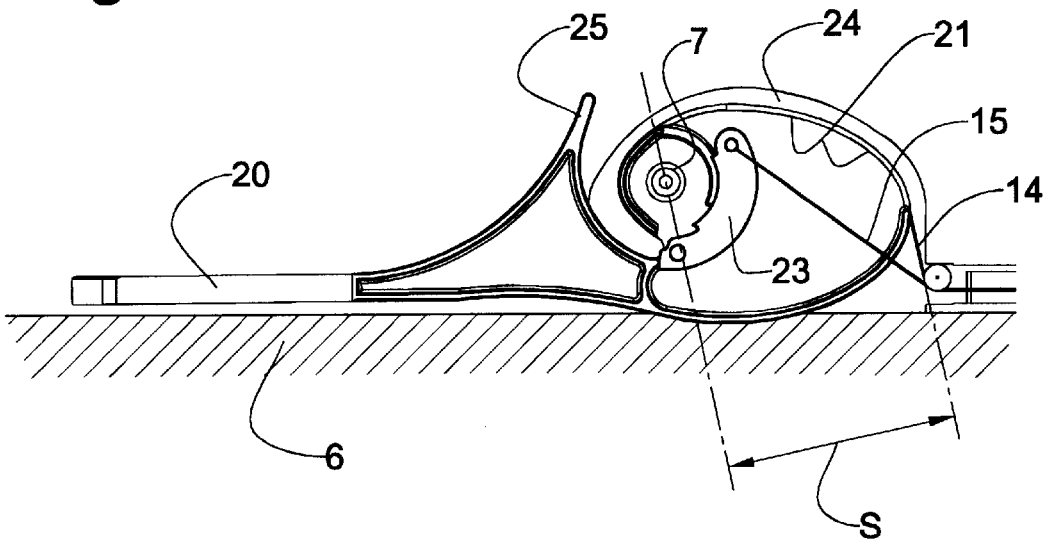

As shown in FIG. 6*a,* when the seat 1 is in its lowered position, the first cable 14 over the cam 21 is at a maximal spacing S and provides a maximal moment and maximal lifting capability.

Figure 6B:
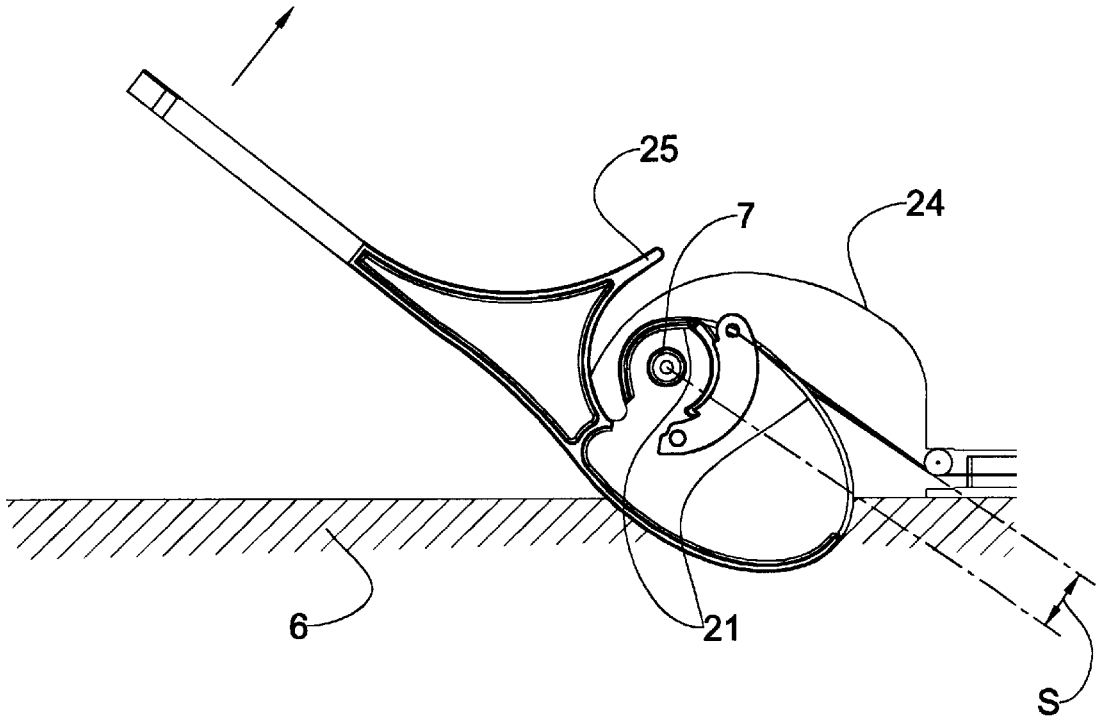

In FIG. 6*b,* when the seat is in its partially elevated position, the first cable is spaced significantly smaller distance, thus producing as smaller moment.

In FIG. 6*c,* when the seat is in its upright position, the first cable 14 is spaced a minimal distance from the pivot 7, minimizing also the torque into the pivot arm 20. This reduced moment avoids banging the seat 1 against the toilet tank 5.

In FIG. 6*d,* the second cable 15 is shown causing the trigger 23 to have released the latch, the compression of the leaf spring 25 urging the pivot arm 20 and associated seat 1 to lower.

Figure 8:
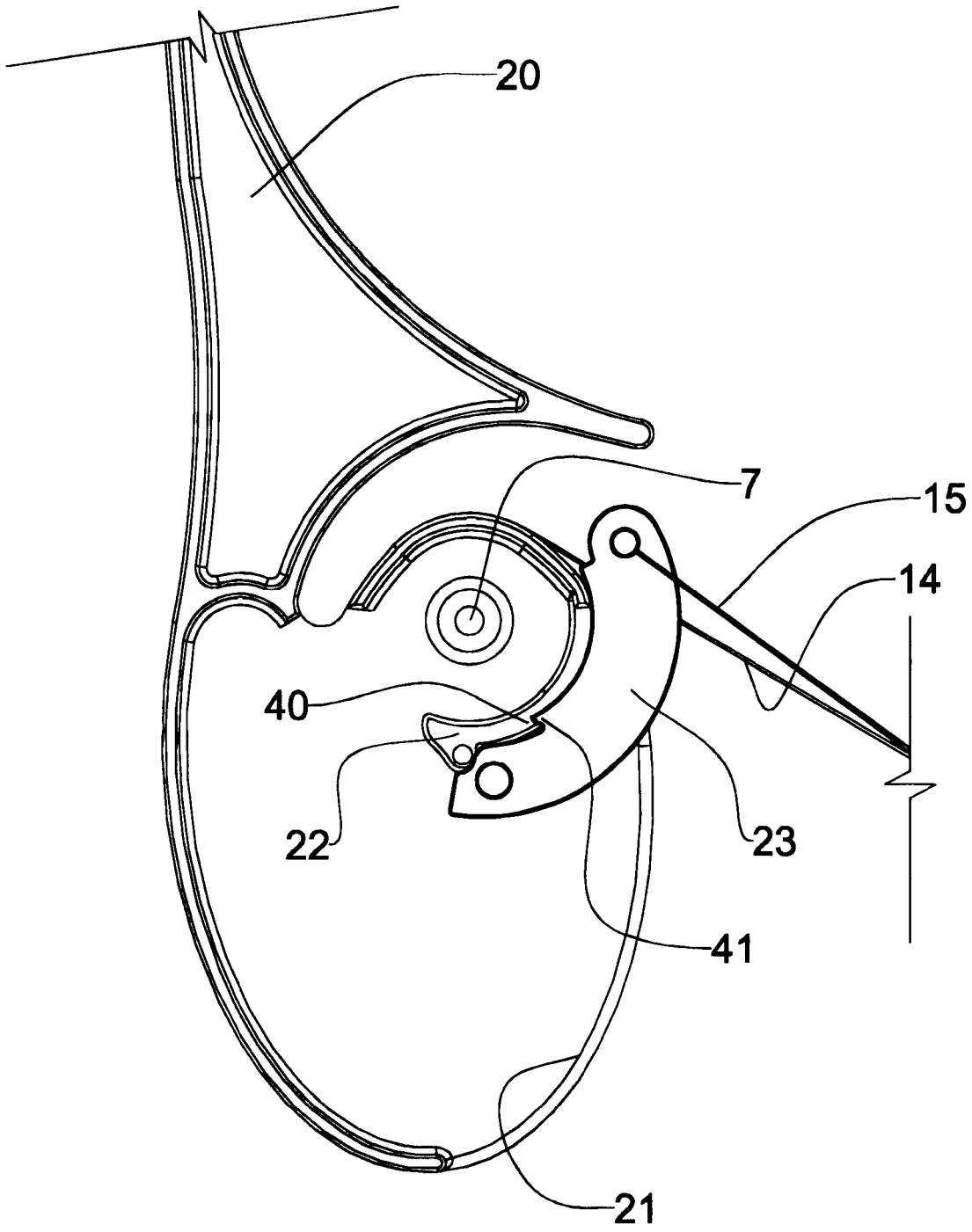
FIG. 8 is a partial side view of the lift mechanism of FIG. 3, illustrating the trigger engaging the latch with the float in the lowered, non-actuating position.
Figure 9:
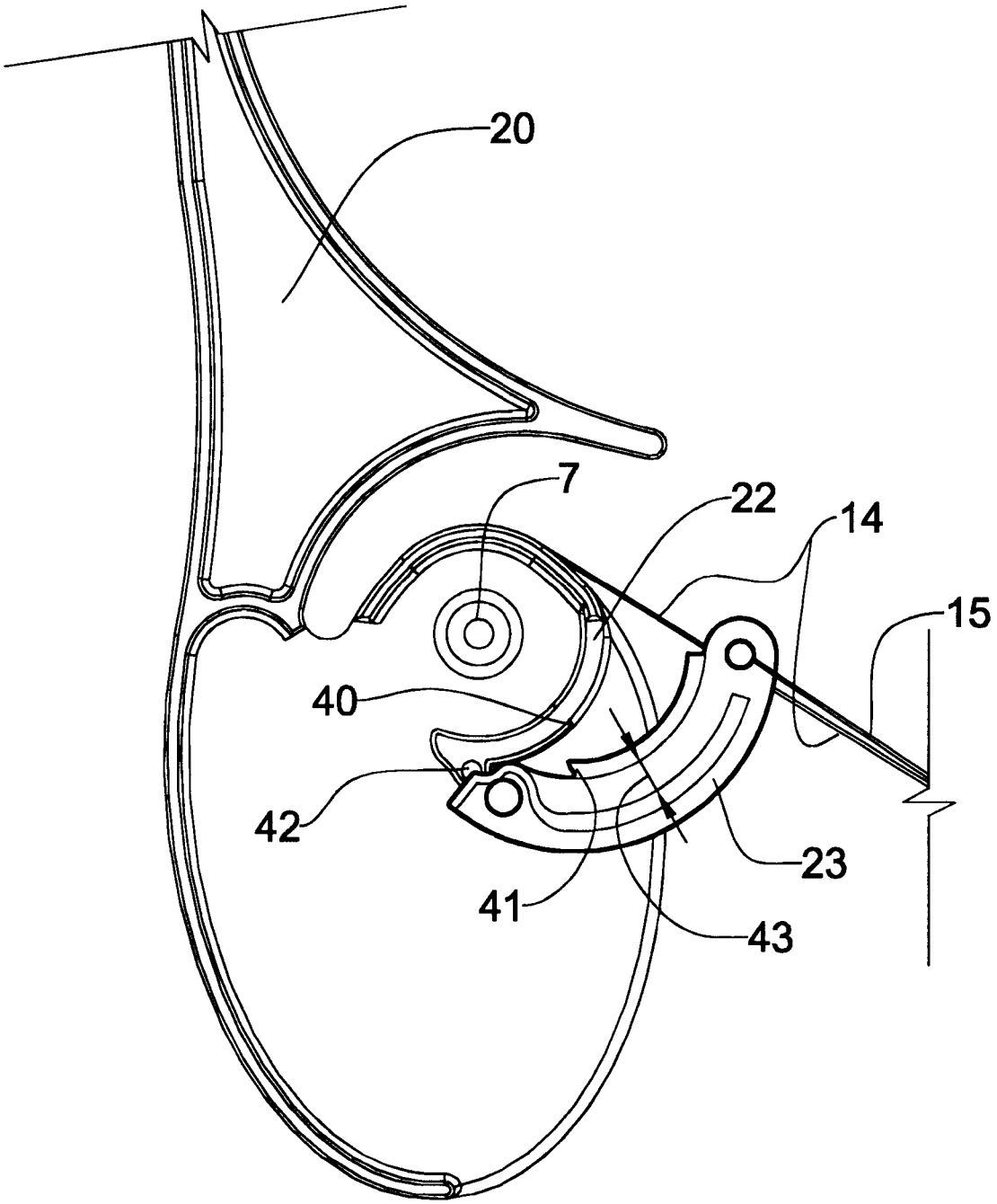
FIG. 9 is a partial side view of the lift mechanism according to FIG. 8 illustrating the second cable being pulled by the raising of the float of FIG. 7 so that the hook is released from the latch.

In more detail, and referring to FIGS. 8, 9, latch 22 is flexible and has a hook 40. The trigger 23 has a corresponding hook 41. Latch 22 also has pin 42 which engages track 43 to reset the trigger 23 after the seat 1 has been lowered. In the seat's lowered position, the hooks 40, 41 do not connect. As the seat 1 is rotated to the upright position, the hooks 40, 41 engage, locking the trigger 23 and locking the seat 1 in the upright position. Referring to FIG. 9, when the trigger 23 is pulled with the second cable 15, pin 42 is levered over the pivoted end of the trigger 23, hooks 40,41 disengage and the seat 1 is released.

Figure 7:
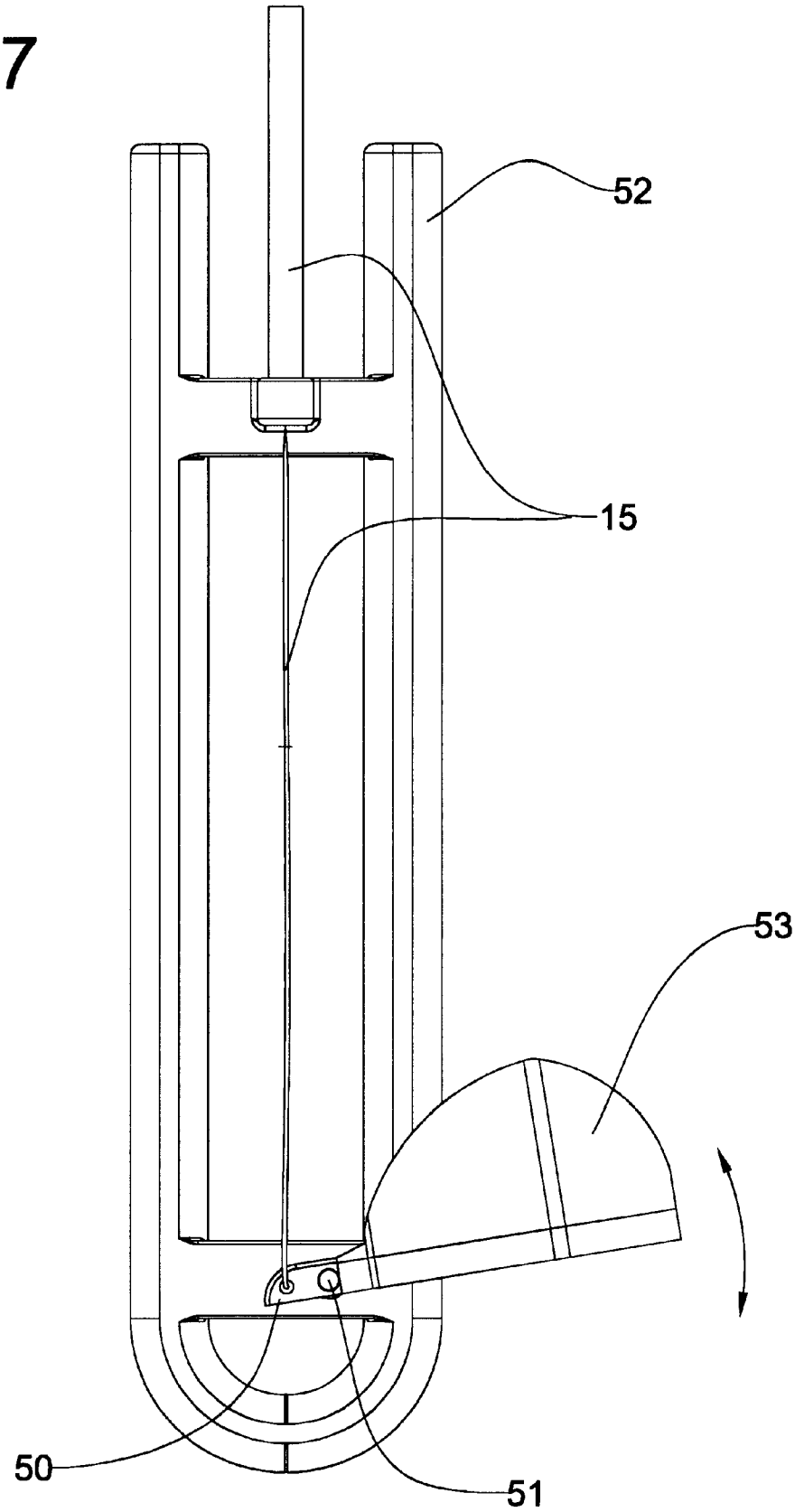
FIG. 7 illustrates the trigger release mechanism with the second cable in the un-released state, float down.

Having reference to FIG. 7, in the toilet implementation, the release mechanism 4 pulls the second cable 15 to release the trigger 23. The release mechanism is suspended by a frame 52 within the toilet tank 5 (FIG. 1—hidden lines) and further comprises a lever 50, a fulcrum 51 and a float 53 which causes the lever 50 to rotate about its fulcrum 51.

Float 53 is an upside-down cup for trapping air beneath it. When the toilet flushes and water drains from the tank 5, the water drains from the float 53 as well. As the water level in the tank 5 refills and rises, the float 53 is buoyed with air and is lifted, pivoting the lever 55 over fulcrum 51, and pulling the second cable 15 for releasing the trigger.

Gravity completes the closure of the seat 1, reset of the float 53, and the reset of the foot pedal 17. As shown in FIGS. 4*a*,4*b* and 6*d,* in combination with the increasing moment arm of the cam 21, and the adjustable spring 19 in the foot-actuating device 3, the seat's fall is braked to prevent slamming of the seat 1.

What is claimed is:

1. Apparatus for rotating an elongate movable member, the member being pivotally mounted to a structure using a pivot mounted with its axis spaced from the center of gravity of the member, the member being rotated about the pivot between substantially horizontal and substantially upright positions, comprising:

(a) a cam having a rotational axis adapted for alignment with said pivot and adapted for connection to the member so that when the cam rotates the member also rotates, the cam having a profile which when pulled along on its tangent creates a large moment for rotating the member from said horizontal position which moment reduces as the member rotates from said horizontal position to the upright position;

(b) a first cable overlying said profile for pulling the cam along its tangent;

(c) a foot operated device adapted to be located adjacent said structure for pulling the first cable; and (d) a sheath, the sheath adapted to be anchored to the structure adjacent the cam and to the foot-actuated device so that the first cable is pulled relative to the sheath by the foot-actuated device.

2. The member rotating apparatus as recited in claim 1 wherein said cam has a radius, and said profile is such that said radius, from said rotational axis to a point at which the first cable pulls tangentially, is initially large when the member is in the horizontal position, and is continuously diminishing as the member rotates to the upright position so that the created moment for lifting the member varies.

3. The apparatus as recited in claim 2 wherein said profile is substantially an ellipse, having a major rotational axis about one focus point and adapted to be connected to the member so that said major rotational axis is approximately parallel with the member.

4. The apparatus as recited claim 1 wherein the cam is adapted to be connected to the member with an arm extending from the cam to the member.

5. The apparatus as recited in claim 1 wherein the foot-actuated device comprises a base, a pedal, and a four-point hinge which, when the pedal is depressed towards the base, causes two opposing points to approach one another and the remaining two opposing points to retreat from one another, the said sheath being secured to one retreating point and said first cable to the other retreating point thereby actuating said first cable, relative to said sheath.

6. The apparatus as recited in claim 5 wherein the pedal has a semicircular curved surface having an apex.

7. The apparatus as recited in claim 6 wherein the semicircular pedal is curved in such a way that the apex of the curve is situated directly over the approaching opposing hinge points, causing maximal actuation of the four-point hinge when depressed.

8. The apparatus as recited in claim 1 further comprising:

(a) a latch formed in the cam;

(b) a trigger which, when the member is in the upright position, engages the latch for holding the member upright; and (c) means for releasing the trigger from the latch.

9. The apparatus as recited in claim 8 wherein the means for releasing the trigger is a second cable connected between the trigger and one end of a lever, the lever rotating on a fulcrum adapted to be located in a toilet tank and having a float at the other end, the float rising as the toilet tank fills with water for rotating the lever and actuating the second cable.

10. The apparatus as recited in claim 1 wherein the member is a toilet seat and the structure to which it is mounted is a toilet.

* * * * *